US011078771B2

(12) United States Patent
Han et al.

(10) Patent No.: US 11,078,771 B2
(45) Date of Patent: Aug. 3, 2021

(54) IDENTIFICATION OF CEMENT IN SUBTERRANEAN BOREHOLE REGIONS USING A RATIO OF CAPTURE TO INELASTIC GAMMA RAYS

(71) Applicant: CARBO CERAMICS INC., Houston, TX (US)

(72) Inventors: Xiaogang Han, Katy, TX (US); Harry D. Smith, Jr., Spring, TX (US); Robert Duenckel, Southlake, TX (US); Jeremy Zhang, Katy, TX (US)

(73) Assignee: CARBO CERAMICS, INC., Houston, TX (US)

( * ) Notice: Subject to any disclaimer, the term of this patent is extended or adjusted under 35 U.S.C. 154(b) by 12 days.

(21) Appl. No.: 16/231,655

(22) Filed: Dec. 24, 2018

(65) Prior Publication Data

US 2019/0242232 A1 Aug. 8, 2019

Related U.S. Application Data

(63) Continuation of application No. 14/805,213, filed on Jul. 21, 2015, now Pat. No. 10,161,237.

(60) Provisional application No. 62/029,276, filed on Jul. 25, 2014.

(51) Int. Cl.
*E21B 43/267* (2006.01)
*E21B 47/11* (2012.01)

(52) U.S. Cl.
CPC ..... *E21B 43/267* (2013.01); *E21B 47/11* (2020.05)

(58) Field of Classification Search
CPC ..... E21B 43/26
See application file for complete search history.

(56) References Cited

U.S. PATENT DOCUMENTS 4,122,340 A * 10/1978 Smith, Jr. ..... G01V 5/105 250/264
4,825,073 A * 4/1989 Smith, Jr. ..... G01V 5/08 250/260
5,252,832 A * 10/1993 Nguyen ..... E21B 47/11 250/390.01
5,327,773 A * 7/1994 Nishimura ..... G01N 9/24 73/30.01
5,572,021 A * 11/1996 Heathman ..... G01V 5/104 250/269.5

(Continued)

OTHER PUBLICATIONS

Reservoir Monitor (RMT™i) Tool, The Industry's Most Accurate and Repeatable Slim-Hole Through-Tubing Carbon/Oxygen Logging System, Formation Evaluation, Halliburton, 2014, 4 pp.

(Continued)

*Primary Examiner* — Steven A MacDonald
(74) *Attorney, Agent, or Firm* — Patterson + Sheridan, LLP

(57) ABSTRACT

Methods are provided for determining the location and height of cement in a subterranean borehole region using pulsed neutron capture (PNC) logging tools. The methods include obtaining a pre-cementing data set, placing in the borehole region a cement slurry that includes a liquid a thermal neutron absorbing material, obtaining a post-cementing data set, comparing the pre-cementing data set and the post-cementing data set to determine the location of the cement, and correlating the location of the cement to a depth measurement of the borehole to determine the location and height of the cement placed in the borehole region.

14 Claims, 6 Drawing Sheets

(56) References Cited

U.S. PATENT DOCUMENTS

| | | | | |
|---|---|---|---|---|
| 5,909,772 | A | 6/1999 | Merkel et al. | |
| 6,005,244 | A * | 12/1999 | Vaeth | G01V 5/101 250/269.2 |
| 8,100,177 | B2 * | 1/2012 | Smith, Jr. | G01V 5/107 166/250.1 |
| 9,038,715 | B2 * | 5/2015 | Smith, Jr. | E21B 43/04 166/250.1 |
| 2009/0205825 | A1 * | 8/2009 | Smith, Jr. | G01V 5/107 166/280.1 |
| 2011/0198488 | A1 * | 8/2011 | Stoller | G01V 5/102 250/258 |
| 2012/0016588 | A1 * | 1/2012 | Evans | G01V 5/104 702/8 |
| 2012/0197529 | A1 * | 8/2012 | Stephenson | G01V 5/101 702/8 |
| 2013/0211724 | A1 * | 8/2013 | Fitzgerald | G01V 5/101 702/8 |
| 2013/0233538 | A1 * | 9/2013 | Chatterji | C09K 8/424 166/250.12 |
| 2013/0234012 | A1 * | 9/2013 | Morris | G01V 5/101 250/269.6 |
| 2013/0292109 | A1 * | 11/2013 | Smith, Jr. | E21B 43/04 166/250.1 |
| 2014/0332678 | A1 | 11/2014 | Tkabladze et al. | |
| 2015/0090871 | A1 * | 4/2015 | Chace | G01V 5/101 250/269.7 |
| 2016/0195636 | A1 * | 7/2016 | Grau | G01V 5/104 250/269.2 |
| 2016/0320523 | A1 * | 11/2016 | Inanc | E21B 49/00 |
| 2016/0349399 | A1 * | 12/2016 | Zhou | G01V 5/102 |
| 2017/0107809 | A1 * | 4/2017 | Hill | G01V 1/345 |
| 2017/0329041 | A1 * | 11/2017 | Zhang | E21B 43/267 |

OTHER PUBLICATIONS

L.A. Jacobson, et al., Application of Pulsed Neutron Logs for Through-Casing Evaluation of Gas, Oil,; and Lithology, SPE Gas Technology Symposium, Apr. 28-May 1, Calgary, Alberta, Canada, 1996, 2 pp.

RSTPro, Water Saturation, Lithology, and Porosity through Casing, Schlumberger, Jul. 2006, 8 pp.

RMT Elite™ Reservoir Monitor Tool, The Industry's Most Accurate and Repeatable Slim-Hole Through-Tubing Carbon/Oxygen Logging System, Wireline and Perforating Services, Halliburton, 2008, 4 pp.

Office Action for U.S. Appl. No. 14/805,213 dated Aug. 8, 2017.

Office Action for U.S. Appl. No. 14/805,213 dated Mar. 13, 2018.

Notice of Allowance for U.S. Appl. No. 14/805,213 dated Sep. 11, 2018.

* cited by examiner

IDENTIFICATION OF CEMENT IN SUBTERRANEAN BOREHOLE REGIONS USING A RATIO OF CAPTURE TO INELASTIC GAMMA RAYS

CROSS-REFERENCE TO RELATED APPLICATIONS

The present application is a continuation application of U.S. patent application Ser. No. 14/805,213, filed Jul. 21, 2015, which claims the benefit of and priority to U.S. Patent Application No. 62/029,276 filed Jul. 25, 2014, the entire disclosures of which are hereby incorporated by reference in their entireties.

FIELD OF THE INVENTION

The present invention relates to hydraulic fracturing operations and cementing operations, and more specifically to methods for identifying an induced subterranean formation fracture and/or cement placed in a borehole region using neutron emission-based logging tools.

BACKGROUND

In order to more effectively produce hydrocarbons from downhole formations, and especially in formations with low porosity and/or low permeability, induced fracturing (called "frac operations", "hydraulic fracturing", or simply "fracing") of the hydrocarbon-bearing formations has been a commonly used technique. In a typical frac operation, fluids are pumped downhole under high pressure, causing the formations to fracture around the borehole, creating high permeability conduits that promote the flow of the hydrocarbons into the borehole. These frac operations can be conducted in horizontal and deviated, as well as vertical, boreholes, and in either intervals of uncased wells, or in cased wells through perforations. In yet other situations to enhance hydrocarbon production in cased holes, pack material is placed only in the annular space between the casing and an interior screen or liner, in a so-called gravel-pack. In a so-called "cased hole frac-pack", the pack material is also placed outside the well casing into formation fractures. In other situations involving an uncased wellbore, in a so-called open-hole fracturing, frac-packing, or gravel packing operation, frac material is placed outside a perforated liner or a screen. In open-hole fracturing and frac-packing, frac material is also placed out into induced fractures in the formation.

In cased boreholes in vertical wells, for example, the high pressure fluids exit the borehole via perforations through the casing and surrounding cement, and cause the formations to fracture, usually in thin, generally vertical sheet-like fractures in the deeper formations in which oil and gas are commonly found. These induced fractures generally extend laterally a considerable distance out from the wellbore into the surrounding formations, and extend vertically until the fracture reaches a formation that is not easily fractured above and/or below the desired frac interval. The directions of maximum and minimum horizontal stress within the formation determine the azimuthal orientation of the induced fractures. Normally, if the fluid, sometimes called slurry, pumped downhole does not contain solids that remain lodged in the fracture when the fluid pressure is relaxed, then the fracture re-closes, and most of the permeability conduit gain is lost.

These solids, called proppants, are generally composed of sand grains or ceramic particles, and the fluid used to pump these solids downhole is usually designed to be sufficiently viscous such that the proppant particles remain entrained in the fluid as it moves downhole and out into the induced fractures. Prior to producing the fractured formations, materials called "breakers", which are also pumped downhole in the frac fluid slurry, reduce the viscosity of the frac fluid after a desired time delay, enabling these fluids to be easily removed from the fractures during production, leaving the proppant particles in place in the induced fractures to keep them from closing and thereby substantially precluding production fluid flow therethrough. In frac-pack or gravel-pack operations, the proppants and/or other pack materials are placed in the annular space between a well casing and an interior screen or liner in a cased-hole frac-pack or gravel-pack, and also in fractures in the formation in the frac-pack. Pack materials can also be placed in an annular space in the wellbore outside a screen or liner in open-hole fracturing, frac-packing, or gravel packing operations. Pack materials are primarily used to filter out solids being produced along with the formation fluids in oil and gas well production operations. This filtration assists in preventing these sand or other particles from being produced with the desired fluids into the borehole and to the surface. Such undesired particles might otherwise damage well and surface tubulars and complicate fluid separation procedures due to the erosive nature of such particles as the well fluids are flowing. In cementing operations, impermeable cement, rather than permeable pack material, is placed in the borehole region outside the well casing, and/or in the space between two or more wellbore tubulars.

The proppants may also be placed in the induced fractures with a low viscosity fluid in fracturing operations referred to as "water fracs". The fracturing fluid in water fracs is water with little or no polymer or other additives. Water fracs are advantageous because of the lower cost of the fluid used. Also when using cross-linked polymers, it is essential that the breakers be effective or the fluid cannot be recovered from the fracture effectively restricting flow of formation fluids. Water fracs, because the fluid is not cross-linked, do not rely on effectiveness of breakers.

Proppants commonly used are naturally occurring sands, resin coated sands, and ceramic proppants. Ceramic proppants are typically manufactured from naturally occurring materials such as kaolin and bauxitic clays, and offer a number of advantages compared to sands or resin coated sands principally resulting from the compressive strength of the manufactured ceramics and their highly spherical particle configuration.

Although induced fracturing has been a highly effective tool in the production of hydrocarbon reservoirs, there is nevertheless usually a need to determine the interval(s) that have been fractured after the completion of the frac operation. It is possible that there are zones within the desired fracture interval(s) which were ineffectively fractured, either due to anomalies within the formation or problems within the borehole, such as ineffective or blocked perforations. It is also desirable to know if the fractures extend vertically across the entire desired fracture interval(s), and also to know whether or not any fracture(s) may have extended vertically outside the desired interval. In the latter case, if the fracture has extended into a water-bearing zone, the resulting water production would be highly undesirable. In all of these situations, knowledge of the location of both the fractured and unfractured zones would be very useful for planning remedial operations in the subject well and/or in utilizing the information gained for planning frac jobs on future candidate wells.

There have been several methods used in the past to help locate the successfully fractured intervals and the extent of the fractures in frac operations. For example, acoustic well logs have been used. Acoustic well logs are sensitive to the presence of fractures, since fractures affect the velocities and magnitudes of compressional and shear acoustic waves traveling in the formation. However, these logs are also affected by many other parameters, such as rock type, formation porosity, pore geometry, borehole conditions, and presence of natural fractures in the formation. Another previously utilized acoustic-based fracture detection technology is the use of "crack noise", wherein an acoustic transducer placed downhole immediately following the frac job actually "listens" for signals emanating from the fractures as they close after the frac pressure has been relaxed. This technique has had only limited success due to: (1) the logistical and mechanical problems associated with having to have the sensor(s) in place during the frac operation, since the sensor has to be activated almost immediately after the frac operation is terminated, and (2) the technique utilizes the sound generated as fractures close, therefore effective fractures, which are the ones that have been propped open to prevent closure thereof, often do not generate noise signals that are as easy to detect as the signals from unpropped fractures, which can generate misleading results.

Arrays of tilt meters at the surface have also been previously utilized to determine the presence of subterranean fractures. These sensors can detect very minute changes in the contours of the earth's surface above formations as they are being fractured, and these changes across the array can often be interpreted to locate fractured intervals. This technique is very expensive to implement, and does not generally have the vertical resolution to be able to identify which zones within the frac interval have been fractured and which zones have not, nor can this method effectively determine if the fracture has extended vertically outside the desired vertical fracture interval(s).

Microseismic tools have also been previously utilized to map fracture locations and geometries. In this fracture location method, a microseismic array is placed in an offset well near the well that is to be hydraulically fractured. During the frac operations, the microseismic tool records microseisms that result from the fracturing operation. By mapping the locations of the microseisms it is possible to estimate the height and length of the induced fracture. However, this process is expensive and requires a nearby available offset well.

Other types of previously utilized fracture location detection techniques employ nuclear logging methods. A first such nuclear logging method uses radioactive materials which are mixed at the well site with the proppant and/or the frac fluid just prior to the proppant and/or frac fluid being pumped into the well. After such pumping, a logging tool is moved through the wellbore to detect and record gamma rays emitted from the radioactive material previously placed downhole, the recorded radioactivity-related data being appropriately interpreted to detect the fracture locations. A second previously utilized nuclear logging method is performed by pumping one or more stable isotopes downhole with the proppant in the frac slurry, such isotope material being capable of being activated (i.e., made radioactive) by a neutron-emitting portion of a logging tool run downhole after the fracing process. A spectroscopic gamma ray detector portion of the tool detects and records gamma rays from the resulting decay of the previously activated "tracer" material nuclei as the tool is moved past the activated material. The gamma spectra are subsequently analyzed to identify the activated nuclei, and thus the frac zones.

A need still exists, however, for subterranean fracture location detection methods which can avoid the need for complex, time consuming data processing.

DETAILED DESCRIPTION

Figure 1:
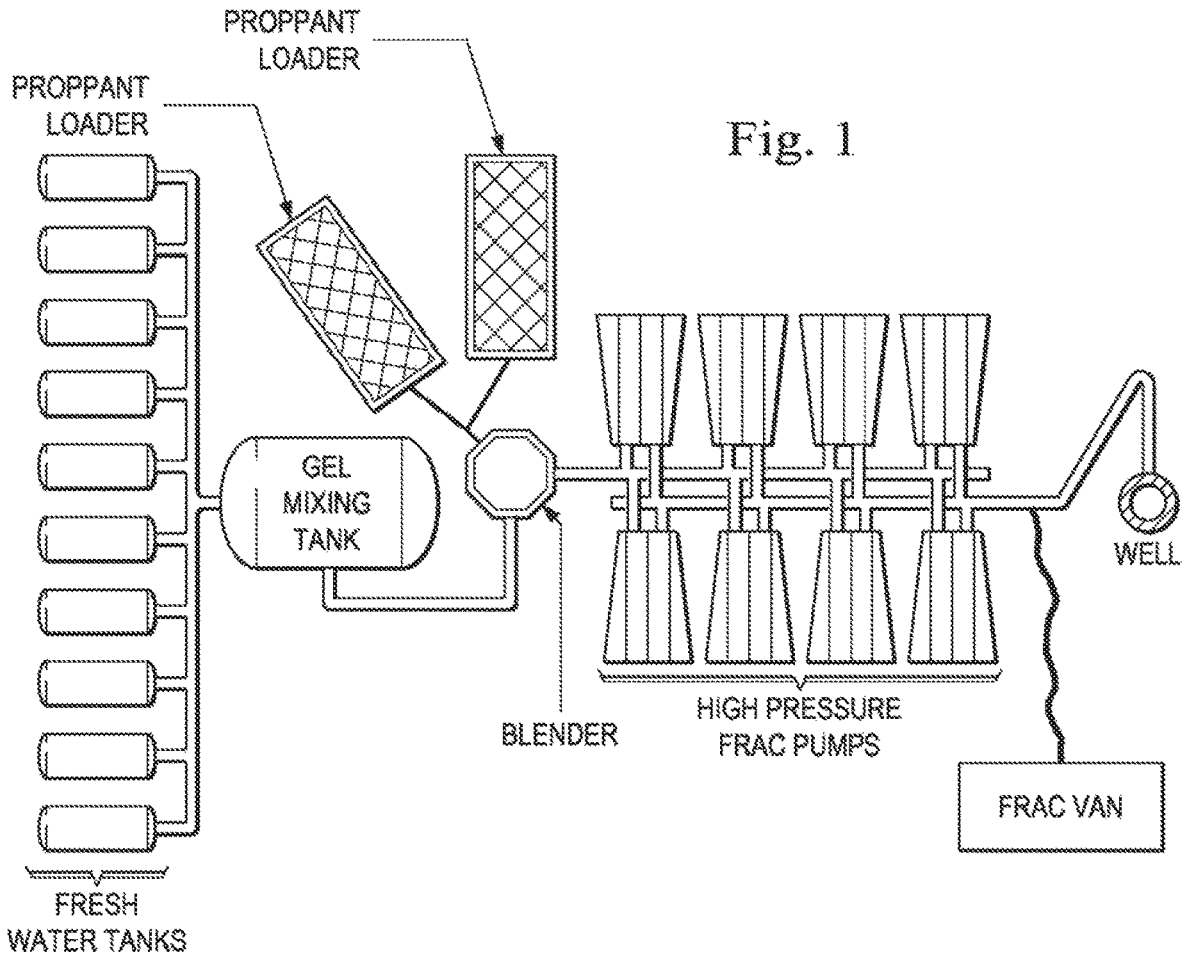
FIG. 1 is a schematic diagram of a wellsite frac layout.

In the methods described herein, the depth of investigation is deeper than nuclear techniques employing downhole neutron activation. There is no possible hazard resulting from flowback to the surface of radioactive proppants or fluids, nor the contamination of equipment at the wellsite. The logistics of the operation are also very simple: (1) the proppant can be prepared well in advance of the required frac operations without worrying about radioactive decay associated with delays, (2) there are no concerns related to radiation exposure to the proppant during proppant transport and storage, (3) any excess proppant prepared for one frac job could be used on any subsequent frac job, and (4) the logging tools required are widely available and generally inexpensive to run. Also, slow logging speed is not generally an issue.

According to several exemplary embodiments a method is provided for determining the location and height of a fracture in a subterranean formation using a pulsed neutron capture (PNC) tool. The method typically includes obtaining a pre-fracture data set, hydraulically fracturing the formation with a slurry that includes a liquid and a proppant in which all or a fraction of such proppant includes a thermal neutron absorbing material, obtaining a post-fracture data set, comparing the pre-fracture data set and the post-fracture data set to determine the location of the proppant, and correlating the location of the proppant to a depth measurement of the borehole to determine the location and height of the propped fracture. According to several exemplary embodiments, the pre-fracture data set can be eliminated. For example, the pre-fracture data set can be eliminated if capture gamma ray spectral data processing is included in the log processing.

The pre-fracture and post-fracture data sets can each be obtained by lowering into a borehole traversing a subterranean formation, a neutron emitting tool including a pulsed fast neutron source and one or more gamma ray detectors, emitting pulses of fast neutrons from the neutron source into the borehole and formation, and detecting in the borehole region inelastic and capture gamma rays resulting from nuclear reactions of the source neutrons with elements in the borehole region and subterranean formation. For purposes of this application, the term "borehole region" includes the logging tool, the borehole fluid, the tubulars in the wellbore and any other annular material such as cement that is located between the formation and the tubular(s) in the wellbore.

PNC logging tools can pulse the neutron source about every millisecond and can measure the resulting gamma radiation produced by interactions of the neutrons from the source with the nuclei of the materials in the formation and borehole region adjacent to the logging tool. The detected PNC related gamma radiation can fall into three categories: (1) inelastic gamma radiation produced by high energy neutron interactions with the downhole nuclei, (2) thermal neutron capture gamma radiation produced almost instantaneously when the thermalized source neutrons are captured by downhole nuclei, and (3) neutron activation gamma radiation, which are produced during the subsequent radioactive decay of nuclei activated by either fast or thermal neutrons.

Inelastic gamma rays are oftentimes produced only during each pulsed neutron burst, since they can only be produced by fast neutron interactions, and the source neutrons lose energy to below the inelastic threshold very quickly after emission from the source (within a few microseconds). Fast neutron flux, and hence the inelastic gamma ray count rate, is insensitive to the thermal neutron absorptive properties (i.e., the thermal neutron capture cross sections) of the downhole nuclei. For example, gadolinium, boron, and samarium (and other rare earth elements), have high thermal neutron capture cross sections, but have only low fast neutron inelastic scattering cross sections. The low inelastic cross sections, coupled with the relatively low amount (<1%) of these NRT tag materials present downhole in the proppant slurry in the fractures (and the fractures themselves only occupy a small percentage volume of the total formation region), means that the inelastic gamma ray count rate in a PNC tool can be insensitive to the presence of the NRT tag material. Hence there can be essentially no significant change in the inelastic gamma count rate between pre-fracture and post-fracture PNC logs caused by NRT tagged proppant.

The PNC thermal neutron capture gamma ray count rate is at least partially dependent on the fast neutron inelastic cross sections of the downhole elements. However, as discussed above, regardless of whether or not NRT tagged proppant is present in an induced fracture, there will be no detectable change in the fast neutron formation inelastic cross section due to the presence of the tag material. Therefore, there will be essentially no change in thermal neutron capture gamma count rate between pre-fracture and post-fracture PNC logs related to inelastic neutron cross sections or fast neutron interactions. The PNC thermal neutron capture gamma ray count rate is, however, very strongly dependent on the thermal neutron absorptive properties of the NRT tag material, as disclosed in: U.S. Pat. Nos. 8,100,177, 8,214,151, 8,234,072; SPE papers 146744 and 152169; and Petrophysics vol. 54, No 5, pp 415-426, each of which are incorporated by reference herein in their entirety. However, none of these references discuss any applications or concepts employing the use of inelastic gamma radiation detected by any downhole pulsed neutron logging tool in locating NRT tagged proppant.

The neutron activation half-lives of downhole nuclei can be from about a few seconds to several hours or more, which can be, at a minimum, thousands of times longer than the pulse rates used in PNC logging tools. Therefore, neutron activation gamma radiation, along with naturally occurring gamma radiation, can contribute a substantially constant background that can be subtracted from the PNC capture and inelastic count rates before these count rates (or spectra) are processed. Therefore, neutron activation gamma radiation can have no or minimal effect (except for changes in counting statistics due to the subtraction process) on either the inelastic or capture gamma ray count rates measured by PNC logging tools.

According to several exemplary embodiments, a method is provided that includes the use of a PNC capture/inelastic gamma ray count rate ratio, C/I, (or an equivalent inelastic/capture ratio) to locate tagged proppant placed in induced downhole fractures. In particular, if a pre-fracture C/I ratio is compared to a post-fracture C/I ratio a reduction in the post-fracture C/I ratio relative to the corresponding pre-fracture C/I ratio can be observed. The inelastic count rates between the two logs (as measured in a time interval/gate during each neutron burst) will be virtually unchanged, as described above. However, capture gamma ray count rates (measured in one or more selected time intervals/gates between the neutron bursts), as also described above, will also be lower on the post-fracture log due to the presence of the thermal neutron absorber in the NRT tag. This results in a lower C/I ratio on the post-fracture log, and hence a comparison or overlay of the pre-fracture and post-fracture C/I ratio logs will be directly indicative of NRT tagged proppant.

Fluctuations and any other changes of pulsed neutron generator output can affect the identification of tagged proppant. A prior method of normalizing gamma rays count rate by using the data outside the interested perforation zones is disclosed in U.S. Pat. Nos. 8,100,177; 8,214,151; 8,234,072; SPE papers 146744 and 152169; and Petrophysics vol. 54, No 5, pp 415-426, each incorporated by reference herein in their entirety. The inelastic gamma ray count rate and capture gamma ray count rate are both directly proportional to the output of the pulsed neutron generator, and hence a C/I ratio can be independent of any neutron generator output changes/fluctuations. By comparing pre-fracture and post-fracture C/I ratio logs, differences can be related to the presence of tagged proppant, but not to changes/fluctuations in neutron generator output between the logs. This is not the case when comparing the observed capture gamma ray count rates between pre-fracture and post-fracture logs, since the capture gamma count rates are sensitive to generator output changes/fluctuations.

According to several exemplary embodiments which utilize a PNC tool, the pre-fracture and post-fracture data sets are used to distinguish proppant in the formation from proppant in the wellbore. According to several exemplary embodiments which utilize a PNC tool, the PNC logging tool generates data that includes log inelastic and capture gamma ray count rates, computed formation thermal neutron capture cross-sections, computed borehole thermal neutron capture cross-sections, computed formation and borehole decay component count rate related parameters, and/or the computed yield of the tag material in the proppant and possibly other downhole materials, as derived from analysis of the capture (and possibly inelastic) gamma ray spectra obtained by the tool.

According to several exemplary embodiments, the pre-fracture and post-fracture data sets are normalized prior to comparing the pre-fracture and post-fracture data sets. Normalization involves adjusting the pre-fracture and post-fracture data for environmental and/or tool differences prior to comparing the data sets. According to several exemplary embodiments, the pre-fracture and post-fracture data sets are not normalized prior comparing the pre-fracture and post-fracture data sets.

According to several exemplary embodiments, the frac slurry includes a proppant containing the thermal neutron absorbing material. The proppant doped with the thermal neutron absorbing material has a thermal neutron capture cross-section exceeding that of elements normally encountered in subterranean zones to be fractured. According to several exemplary embodiments, the proppant containing the thermal neutron absorbing material has a macroscopic thermal neutron capture cross-section of at least about 90 capture units. According to several exemplary embodiments, the proppant containing the thermal neutron absorbing material has a macroscopic thermal neutron capture cross-section of at least about 900 capture units. According to several exemplary embodiments, the proppant material is a granular ceramic material, with substantially every grain of the proppant material having a high capture cross section thermal neutron absorbing material integrally incorporated therein.

According to several exemplary embodiments, the thermal neutron absorbing material is gadolinium, boron, cadmium, iridium, or mixtures thereof.

According to several exemplary embodiments which utilize a PNC logging tool, capture gamma ray spectroscopy and spectral deconvolution may be used to detect, isolate, and identify gamma radiation which was emitted following thermal neutron capture by the thermal neutron absorbing material in the proppant.

Suitable high capture cross-section materials include gadolinium oxide, samarium oxide, boron carbide, and combinations thereof. A proppant containing 0.030% by weight of gadolinium oxide has a macroscopic capture cross-section of approximately 92 capture units. A suitable proppant containing 0.1% by weight boron carbide or 0.1% samarium oxide has similar thermal neutron absorption properties.

According to several exemplary embodiments, the proppant includes a concentration of about 0.03% to about 1.0% by weight of a gadolinium compound thermal neutron absorbing material, or a concentration of about 0.1% to 4.0% by weight of a samarium compound thermal neutron absorbing material. Suitable tagged proppants could also contain combinations of two or more different thermal neutron absorbing materials, such as gadolinium oxide in one portion of the proppant grains and samarium oxide in another portion of (or the balance of) the proppant grains.

According to several exemplary embodiments, the proppant may be a ceramic proppant, sand, resin coated sand, plastic beads, glass beads, and other ceramic or resin coated proppants. Such proppants may be manufactured according to any suitable process including, but not limited to continuous spray atomization, spray fluidization, spray drying, or compression. Suitable proppants and methods for manufacture are disclosed in U.S. Pat. Nos. 4,068,718, 4,427,068, 4,440,866, 5,188,175, and 7,036,591, the entire disclosures of which are incorporated herein by reference.

According to several exemplary embodiments, the thermal neutron absorbing material is added to the ceramic proppant during the manufacturing process such as continuous spray atomization, spray fluidization, spray drying, or compression. Ceramic proppants vary in properties such as apparent specific gravity by virtue of the starting raw material and the manufacturing process. The term "apparent specific gravity" as used herein is the weight per unit volume (grams per cubic centimeter) of the particles, including the internal porosity. Low density proppants generally have an apparent specific gravity of less than 3.0 g/cm$^3$ and are typically made from kaolin clay and alumina. Intermediate density proppants generally have an apparent specific gravity of about 3.1 to 3.4 g/ cm$^3$ and are typically made from bauxitic clay. High strength proppants are generally made from bauxitic clays with alumina and have an apparent specific gravity above 3.4 g/ cm$^3$. According to several exemplary embodiments, thermal neutron absorbing material may be added in the manufacturing process of any one of these proppants to result in a suitable proppant. Ceramic proppant may be manufactured in a manner that creates porosity in the proppant grain. A process to manufacture a suitable porous ceramic is described in U.S. Pat. No. 7,036,591, the entire disclosure of which is incorporated by reference herein. In this case the thermal neutron absorbing material is impregnated into the pores of the proppant grains to a concentration of about 0.025 to about 4.0% by weight.

According to several exemplary embodiments, the thermal neutron absorbing material is incorporated into a resin material and ceramic proppant or natural sands are coated with the resin material containing the thermal neutron absorbing material. Processes for resin coating proppants and natural sands are well known to those of ordinary skill in the art. For example, a suitable solvent coating process is described in U.S. Pat. No. 3,929,191, to Graham et al., the entire disclosure of which is incorporated herein by reference. Another suitable process such as that described in U.S. Pat. No. 3,492,147 to Young et al., the entire disclosure of which is incorporated herein by reference, involves the coating of a particulate substrate with a liquid, uncatalyzed resin composition characterized by its ability to extract a catalyst or curing agent from a non-aqueous solution. Also a suitable hot melt coating procedure for utilizing phenol-formaldehyde novolac resins is described in U.S. Pat. No. 4,585,064, to Graham et al., the entire disclosure of which is incorporated herein by reference. Those of ordinary skill in the art will be familiar with still other suitable methods for resin coating proppants and natural sands.

Therefore, according to several exemplary embodiments, a method is provided which may be implemented with ceramic proppant or natural sands coated with or otherwise containing the thermal neutron absorbing material. According to several exemplary embodiments, a suitable thermal neutron absorbing material is gadolinium oxide, which has an effective thermal neutron absorbing capacity at a low concentration in tagged proppant or sand. The concentration of such thermal neutron absorbing materials is generally on the order of about 0.025% to about 4.0% by weight of the proppant. For gadolinium compounds such as gadolinium oxide, the concentration is about 0.025% to about 1.0% by weight of the proppant. These concentrations are low enough such that the other properties of the tagged proppant (such as crush strength) are essentially unaffected by the addition of the high capture cross section material. According to several exemplary embodiments, any high capture cross-section thermal neutron absorbing material may be used. According to several exemplary embodiments, gadolinium oxide or other gadolinium containing materials are used because a smaller amount of the gadolinium-containing tagging material is required relative to other thermal neutron absorbing materials (such as other rare earth elements). The weight percentage required to produce similar thermal neutron absorption properties for other high thermal neutron capture cross section materials will be a function of the density and molecular weight of the material used, and on the capture cross sections of the constituents of the material.

A manufactured ceramic proppant containing about 0.025% to about 1.0% by weight of a thermal neutron absorbing material can be cost effectively produced, and can provide useful fracture identifying signals when comparing PNC log responses run before and after a frac job. These signals are capable of indicating and distinguishing between the intervals that have and those that have not been fractured and propped.

As shown in FIG. 1, a well site fracturing operation involves blending water with a gel to create a viscous fracturing fluid. The proppant including a thermal neutron absorbing material is added to the viscous fracturing fluid creating a slurry, which is pumped down the well with high pressure pumps. The high-pressure slurry is forced into the fractures induced in the formation, and possibly also into the borehole region adjacent to the fractures. The proppant particles are pumped downhole in a liquid (frac slurry) and into the induced fractures, and also possibly into the borehole region adjacent to the zones where the fractures have penetrated into the surrounding formations.

Figure 2:
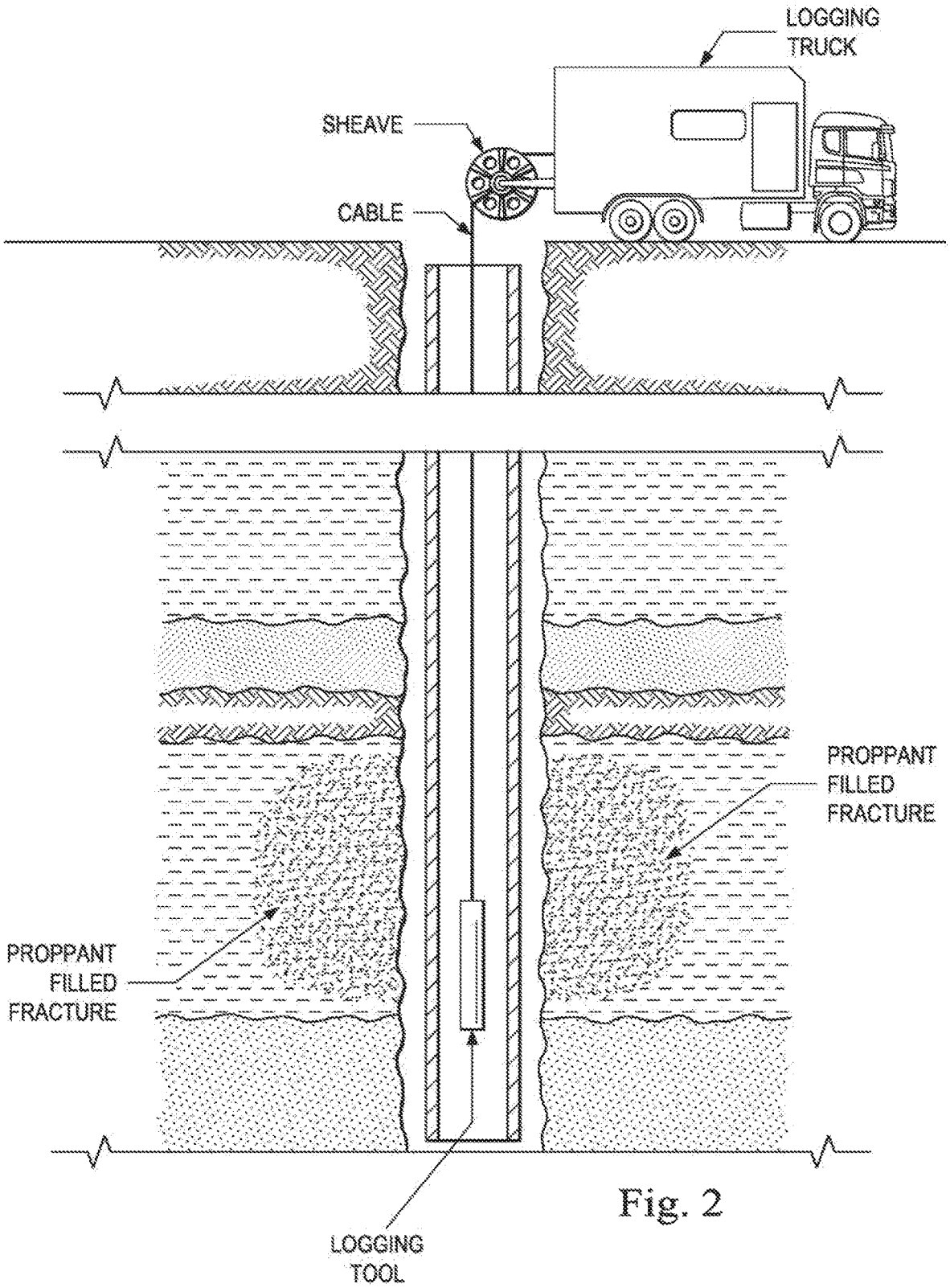
FIG. 2 is a schematic view showing logging of a downhole formation containing induced fractures.

FIG. 2 depicts a logging truck at the well site with a neutron, compensated neutron, or PNC logging tool at the depth of the induced fracture. Power from the logging truck (or skid) is transmitted to the logging tool, which records and transmits logging data as the tool is logged past the fracture zone(s) and the formations above and/or below the zone(s) being fractured.

According to several exemplary embodiments, the induced hydraulic fracture identification process using a proppant having a thermal neutron absorbing material and measurements from a pulsed neutron capture (PNC) logging tool includes:

1. Preparing proppant doped with a thermal neutron absorbing material by fabricating the proppant from starting materials that include a thermal neutron absorbing material, by coating the thermal neutron absorbing material onto the proppant or by impregnating or otherwise incorporating the thermal neutron absorbing material into the proppant particles.

2. Running and recording, or otherwise obtaining, a pre-fracture PNC log across the potential zones to be fractured to obtain a pre-fracture data set, and optionally also including zones outside the potential fracture zones.

3. Conducting a hydraulic fracturing operation in the well, incorporating the proppant having a thermal neutron absorbing material into the frac slurry pumped downhole.

4. Running and recording a post-fracture PNC log (utilizing the same log type as used in the pre-fracture log) across the potential zones of fracture including one or more fracture intervals to obtain a post-fracture data set, and optionally also including zones outside the interval where fracturing was anticipated. The logs may be run with the tool centered or eccentered within the casing or tubing. According to several exemplary embodiments, the pre-fracture and post-fracture logs are run in the same condition of eccentricity.

5. Comparing the pre-fracture and post-fracture data sets from the pre-fracture and post-fracture logs (after any log normalization), to determine location of proppant. According to several exemplary embodiments, normalization is conducted if the pre-fracture and post-fracture logs were run with different borehole conditions, or if different tools or sources were used. This may be especially true if the pre-fracture log was recorded at an earlier time in the life history of the well, using wireline, memory, and/or logging-while-drilling (LWD) sensors. According to several exemplary embodiments, normalization procedures compare the log data from zones outside of the possibly fractured intervals in the pre-fracture and post-fracture logs. Since these zones have not changed between the logs, the gains and/or offsets are applied to the logs to bring about agreement between the pre-fracture and post-fracture logs in these normalization intervals. The same gains/offsets are then applied to the logs over the entire logged interval. Differences in the data indicate the presence of proppant in the fracture and/or the borehole region adjacent to a fracture.

For PNC tools, increases in computed formation and/or borehole capture cross-sections, decreases in the computed borehole and/or formation capture gamma count rates in selected time intervals between the neutron bursts in the post-fracture log relative to the pre-fracture log, increases in the spectrally derived yield of the tag material absorber on the post-fracture log, and/or decreases in the ratio of detected capture gamma rays to inelastic gamma rays (C/I) on the post-fracture log indicate the presence of proppant containing a thermal neutron absorbing material.

6.Detecting the location and height of the fracture by correlating the differences in the pre-fracture and post-fracture data sets to a depth measurement of the borehole. These differences can be measured using well logs, as shown in the exemplary well log of FIGS. 5A and 5B.

According to several exemplary embodiments, methods are provided in which multiple pre-fracture logs are incorporated into the pre-fracture versus post-fracture comparisons, or simulated logs are used for the pre-fracture log (such simulated logs being obtained for instance using neural networks to generate simulated PNC log responses from other open or cased hole logs on the well), or multiple stationary logging measurements are used instead of, or in addition to, data collected with continuous logs.

According to several exemplary embodiments, first and second post-fracture data sets are obtained and utilized to determine the differences, if any, between the quantities of proppant in the fracture zones before producing a quantity of well fluids from the subterranean formation and the quantities of proppant in the fracture zones after such production by comparing the post-fracture data sets. The determined proppant quantity differences are utilized to determine one or more production and/or fracture-related characteristics of the subterranean formation such as: (a) one or more of the fracture zones is not as well propped as it was initially, (b) production from one or more of the fracture zones is greater than the production from the other zones, and (c) one or more of the fracture zones is not producing. This post-fracturing procedure may be carried out using a pulsed neutron capture logging tool, which may be augmented with other wellsite information or information provided by other conventional logging tools, such as production logging tools.

According to several exemplary embodiments of the thermal neutron logging method, fast neutrons are emitted in pulses from a neutron source into the wellbore and formation, and are rapidly thermalized to thermal neutrons by elastic and inelastic collisions with formation and borehole region nuclei. The inelastic collisions between fast source neutrons and downhole nuclei can result in the almost instantaneous emission of inelastic gamma radiation, which causes the neutrons to lose energy. Elastic collisions with hydrogen in the formation and the borehole region are a principal thermalization mechanism. Once thermalized, the thermal neutrons diffuse in the borehole region and the formation, and are eventually absorbed by one of the nuclei present. Generally these absorption reactions result in the almost simultaneous emission of capture gamma rays; however, absorption by boron is a notable exception. The detectors in the logging tool either directly detect the thermal neutrons that are scattered back into the tool (in some older versions of PNC tools), or indirectly by detecting the gamma rays resulting from the inelastic scattering and thermal neutron absorption reactions (in most commercial versions of PNC tools). Most PNC tools are configured with a neutron source and two detectors arranged above the neutron source which are referred to herein as a "near" detector and a "far" detector. According to several exemplary embodiments, the methods include the use of pulsed neutron capture tools that include one or more detectors. For example, suitable PNC tools incorporate a neutron source and three detectors arranged above the neutron source, which are referred to herein as the near, far, and "extra-far" or "xfar" detectors such that the near detector is closest to the neutron source and the xfar detector is the farthest away from the neutron source. It is also possible that one or more of the neutron detectors may be located below the neutron source.

A pulsed neutron capture tool logging system measures the decay rate (as a function of time between the neutron pulses) of the thermal neutron or capture gamma ray population in the formation and the borehole region. From this decay rate curve, the capture cross-sections of the formation $\Sigma_{fm}$ (sigma-fm) and borehole $\Sigma_{bh}$ (sigma-bh), and the formation and borehole decay components, can be resolved and determined. The higher the total capture cross-sections of the materials in the formation and/or in the borehole region, the greater the tendency for that material to capture thermal neutrons. Therefore, in a formation having a high total capture cross-section, the thermal neutrons disappear more rapidly than in a formation having a low capture cross-section. This appears as a steeper slope in a plot of the observed count rate versus time after the neutron burst.

Figure 5A:
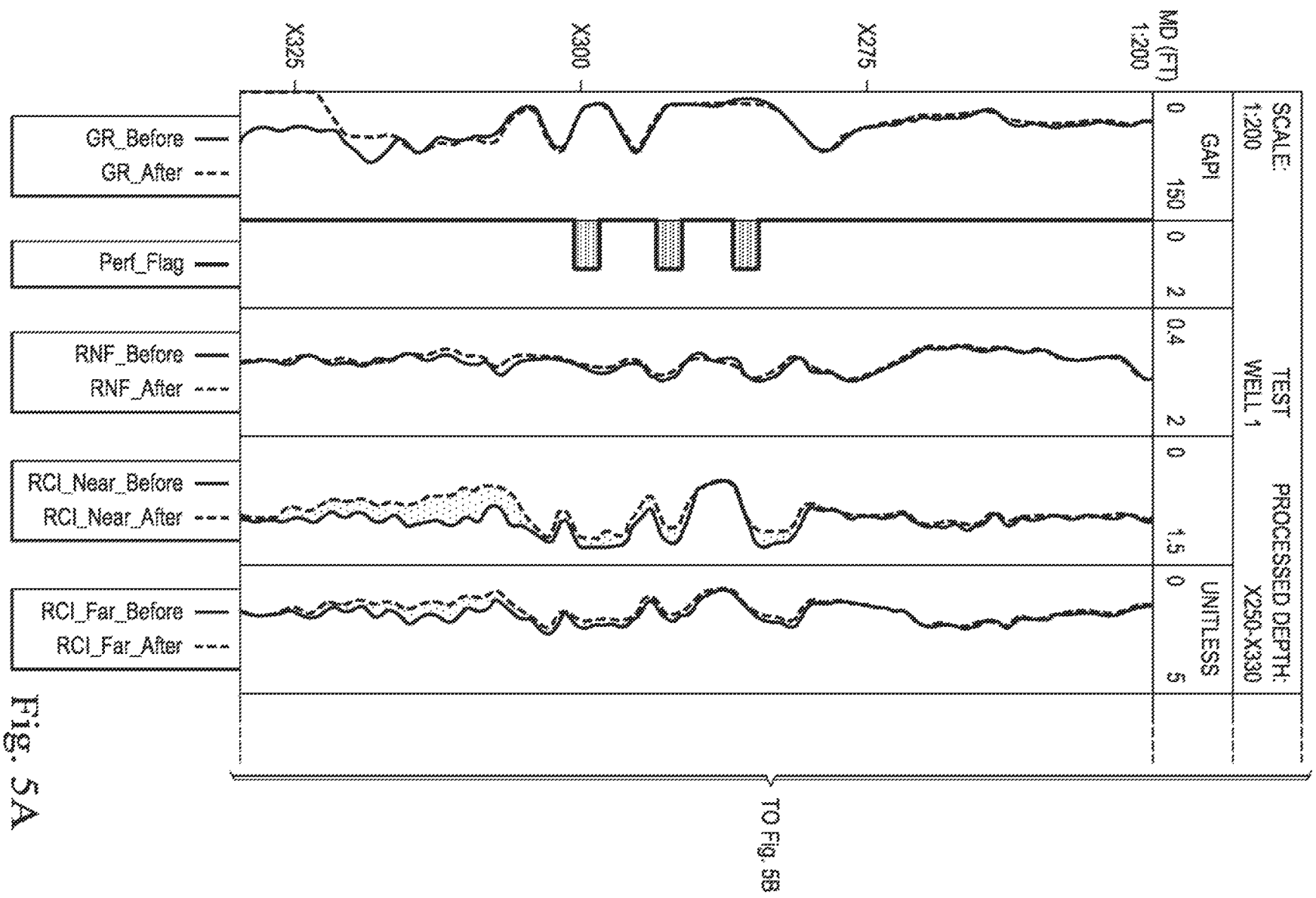
FIGS. 5A and 5B show an exemplary pulsed neutron tool-based field well log for identification of tagged proppant in induced fractures in the formation and the borehole region. Various data collected in two detectors in the pulsed neutron tool during and between the neutron bursts are processed to develop the curves in the figures which are then utilized to detect proppant tagged with a material having a high thermal neutron capture cross section in the fractures.
Figure 5B:
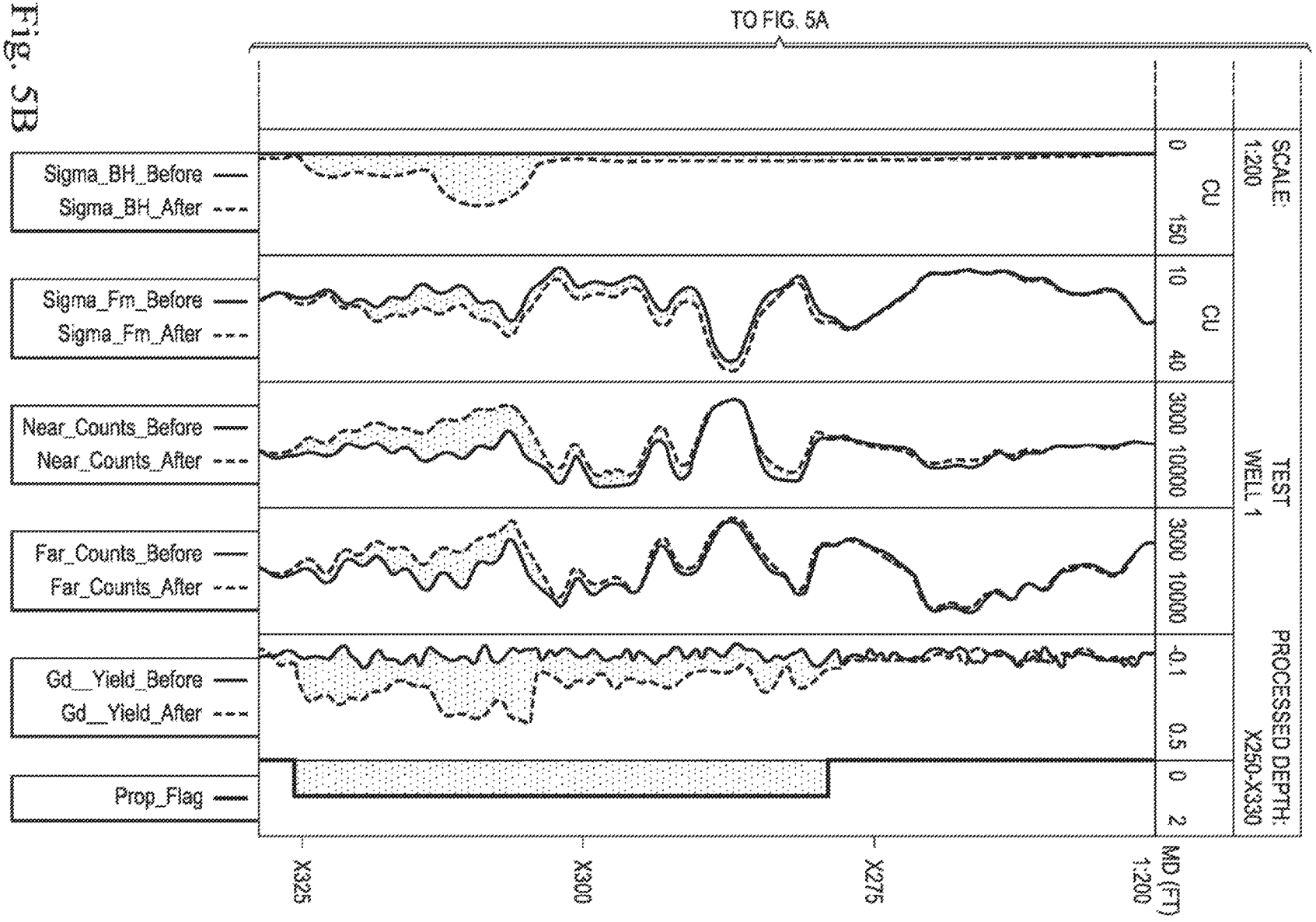

The differences between the PNC borehole and formation pre-fracture and post-fracture parameters can be used to locate the tagged proppant, as shown in the exemplary log in FIGS. 5A and 5B. Due to the different depths of investigation of the various PNC measurement parameters, it is also possible to distinguish proppant in the formation from proppant in the wellbore.

The modeling data used to generate FIG. 4 and Tables 1-3 below, was modeled using pulsed neutron tools employing gamma ray detectors. Those of ordinary skill in the art will understand that it would also be possible to employ corresponding processing for these tools making thermal neutron measurements instead of capture gamma ray measurements, and making fast neutron measurements (using fast neutron detectors) instead of inelastic gamma ray measurements, or by using detectors which sense both neutrons and gamma rays. The PNC data used to generate the data in Tables 1-3 below were modeled using tools employing gamma ray detectors. According to several exemplary embodiments, the gamma ray detectors are time gated relative to the neutron burst so that both inelastic and capture gamma radiation can be detected. To detect inelastic gamma rays, which essentially occur only during the neutron bursts when fast neutron are present, the detectors are time gated to count only during the neutron burst, and the count rates detected are usually corrected for any residual capture or activation gamma rays from prior neutron bursts. A time gated gamma ray detector measures capture gamma rays emitted between the neutron bursts, when thermalized neutrons are captured by elements in the vicinity of the thermal neutron "cloud" in the wellbore and formation. The capture gamma rays can be detected in several different time gates between the neutron bursts, with gates farther removed in time from the preceding burst containing a higher percentage of counts from gamma rays from the formation region and the fracture in the formation relative to gamma rays from the borehole region.

The following examples are presented to further illustrate various aspects of the several exemplary embodiments, and are not intended to be limiting. The examples set forth below, with the exception of the exemplary well logs shown in FIG. 5., were generated using the Monte Carlo N-Particle Transport Code version 5 (hereinafter "MCNP5"). The MCNP5 is a software package that was developed by Los Alamos National Laboratory and is commercially available within the United States from the Radiation Safety Information Computation Center (http://www-rsicc.ornl.gov). The MCNP5 software can handle geometrical details and accommodates variations in the chemical composition and size of all modeled components, including borehole fluid salinity, the concentration of the thermal neutron absorbing material in the proppant in the fracture, and the width of the fracture. The MCNP5 data set forth below resulted in statistical standard deviations of approximately 0.5-1.0% or less in the computed count rates and associated parameters.

In all of the following, the proppant was doped with gadolinium oxide, however other high capture cross section thermal neutron absorbers could alternatively (or additionally) be used. According to several exemplary embodiments, the proppant is a granular ceramic material and the dopant/tag material is integrally incorporated into substantially every grain of the proppant. In other embodiments only a portion of the proppant grains contain tagged proppant. For example, the tagged proppant (or other tagged solid) can be mixed with other materials which do not contain tagged material, such as cement, gravel pack solids, or frac pack solids, to provide a composite tagged material for use in cementing, gravel packing, or frac-packing operations.

Figure 3A:
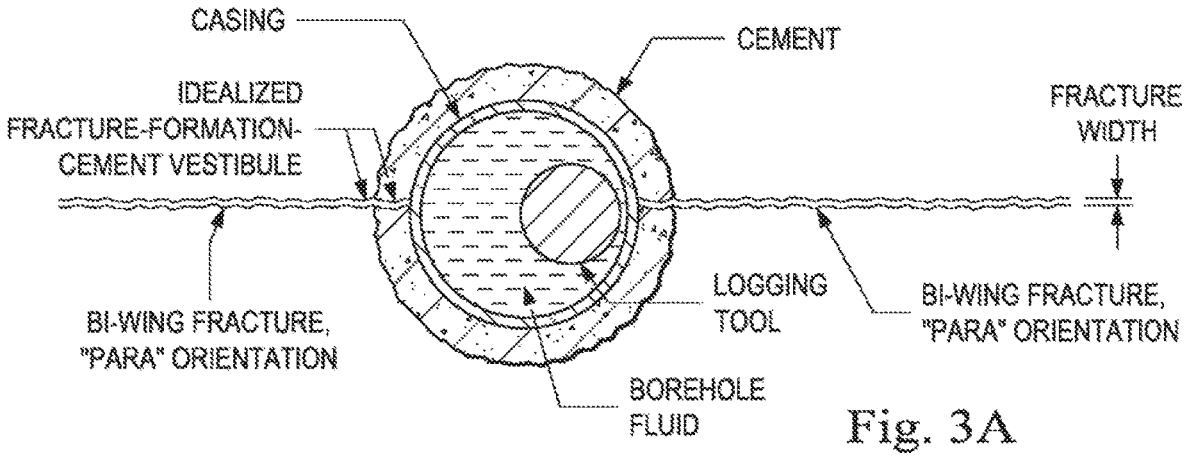
FIGS. 3A and 3B are plan views from the orientation of the Z-axis with respect to "para" and "perp" tool placement geometries relative to the fracture.
Figure 3B:
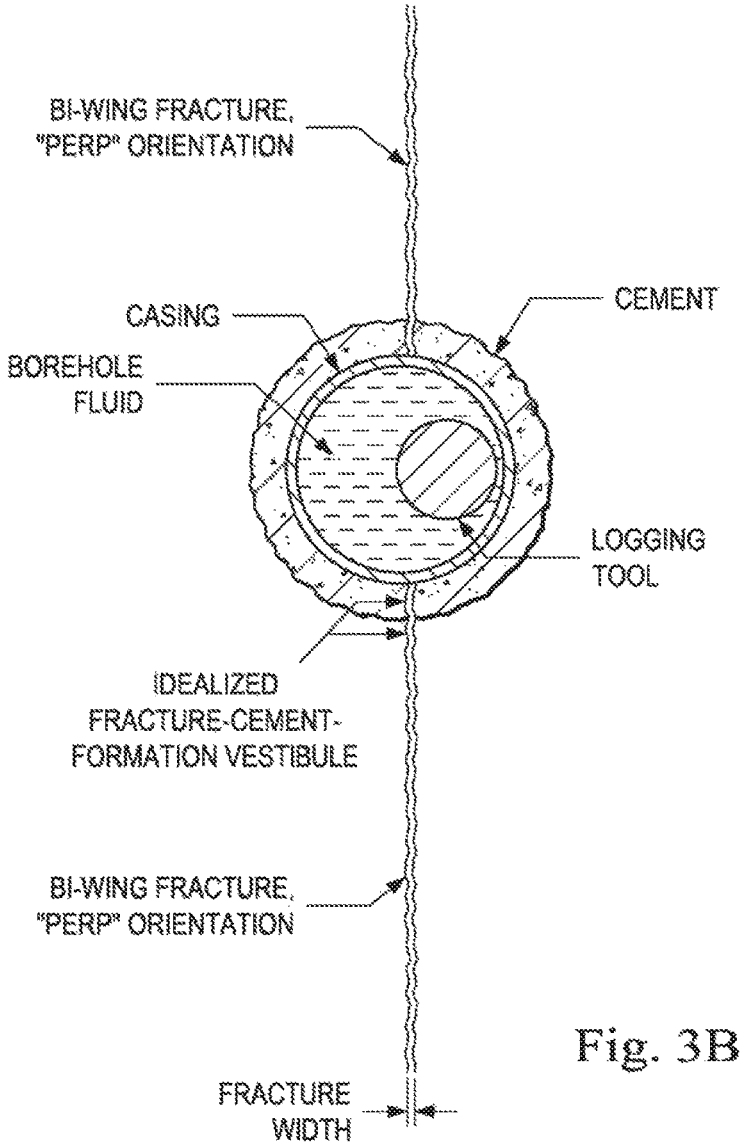

For the purposes of the following examples, FIGS. 3A and 3B present views along the Z-axis of the geometries used in the MCNP5 modeling. In all cases the 8 inch diameter borehole is cased with a 5.5 inch O.D. 24 lb/ft. steel casing and no tubing, and is surrounded by a ~1 inch wide cement annulus. The 1.6875 inch diameter tool is shown in the parallel ("para") position in FIG. 3A and in the perpendicular ("perp") position in FIG. 3B. In the "para" position, the decentralized logging tool is aligned with the fracture, and in the "perp" position it is positioned 90° around the borehole from the fracture. In the PNC data described in FIG. 4 and Tables 1-3, the modeling was done with the tool positioned as shown in FIG. 3A, since with PNC tools, the azimuthal tool position in the borehole relative to the fracture is much less significant than with neutron or compensated neutron tools.

In FIGS. 3A and 3B, the formation area outside the cement annulus was modeled as a sandstone with a matrix capture cross-section of 10-15 capture units (cu). Data was collected for water-saturated formations with several porosities. These two figures show the idealized modeling of the formation and borehole region that was used in most MCNP5 runs. The bi-wing vertical fracture extends radially away from the wellbore casing, and the frac slurry in the fracture channel replaces the cement in the channel as well as the formation in the channel outside the cement annulus. The width of the fracture channel was varied between 0.1 cm and 1.0 cm in the various modeling runs. In some studies, part or all of the cement annulus was replaced by proppant doped with gadolinium oxide. The MCNP5 model does not provide output data in the form of continuous logs, but rather data that permit, in given formations and at fixed positions in the wellbore, comparisons of pre-fracture and post-fracture logging responses.

A PNC system having a 14-MeV pulsed neutron generator was modeled using MCNP5 to determine the height of a fracture in a formation. Decay curve count rate data detected in gamma ray sensors are recorded after fracturing the formation. The observed PNC parameters are then compared to corresponding values recorded in a logging run made before the well was fractured, again, according to several exemplary embodiments, made with the same or a similar logging tool and with the same borehole conditions as the post-fracture log. The formation and borehole thermal neutron absorption cross-sections are calculated from the two-component decay curves. Increases in the formation and/or borehole thermal neutron absorption cross-sections in the post-fracture PNC logs relative to the pre-fracture logs, as well as decreases between the logs in the observed count rates and in computed formation and/or borehole component count rates and count rate integrals are used to identify the presence of tagged/doped proppant in the induced fracture(s) and/or in the borehole region adjacent to the fractured zone. Inelastic gamma ray count rates measured during the neutron bursts are also measured, and the inelastic data is combined with the capture gamma ray count rates detected in selected time gate(s) between the neutron bursts. This combination can be observed via a capture to inelastic (C/I) count rate ratio.

According to several exemplary embodiments, a PNC tool is used for data collection and processing to enable observation of both inelastic and capture count rate related changes and changes in computed formation and borehole thermal neutron capture cross-sections so as to identify the presence of the neutron absorber in the proppant. If the PNC tool also has spectral gamma ray detection and processing capabilities, the yield of the tag material (e.g., gadolinium) can also be derived from the capture spectra, and can be used as a direct indicator of the presence of the tag material.

In current "dual exponential" PNC tools, as disclosed in SPWLA Annual Symposium Transactions, 1983 paper CC entitled Experimental Basis For A New Borehole Corrected Pulsed Neutron Capture Logging System (Thermal Multi-gate Decay "TMD") by Shultz et al.; 1983 paper DD entitled Applications Of A New Borehole Corrected Pulsed Neutron Capture Logging System (TMD) by Smith, Jr. et al.; and 1984 paper KKK entitled Applications of TMD Pulsed Neutron Logs In Unusual Downhole Logging Environments by Buchanan et al., the equation for the detected count rate c(t), measured in the thermal neutron (or gamma ray) detectors as a function of time between the neutron bursts can be approximated by Equation 1:

$$c(t)=A_{bh}\exp(-t/\tau_{bh})+A_{fm}\exp(-t/\tau_{fm}) \quad (1)$$

where t is time after the neutron pulse, $A_{bh}$ and $A_{fm}$ are the initial magnitudes of the borehole and formation decay components at the end of the neutron pulses (sometimes called bursts), respectively, and $\tau_{bh}$ and $\tau_{fm}$ are the respective borehole and formation component exponential decay constants. The borehole and formation component capture cross-sections $\Sigma_{bh}$ and $\Sigma_{fm}$ are inversely related to their respective decay constants by the relations:

$$\tau_{fm}=4550/\Sigma_{fm}, \text{ and } \tau_{bh}=4550/\Sigma_{bh}, \quad (2)$$

where the cross-sections are in capture units and the decay constants are in microseconds.

An increase in the capture cross-section $\Sigma_{fm}$ will be observed in the post-fracture logs with proppant in the formation fractures relative to the pre-fracture pulsed neutron logs. Fortunately, due to the ability in PNC logging to separate the count rate signals from the borehole and formation, there will also be a reduced sensitivity in the formation capture cross-section to any unavoidable changes in the borehole region (such as borehole salinity or casing changes) between the pre-fracture and post-fracture pulsed neutron logs, relative to situations in which neutron or compensated neutron tools are used to make the measurements.

The formation component count rate will also be affected (reduced) by the presence of the thermal neutron absorber(s) in the proppant in the fractures, especially of interest in PNC tools having gamma ray detectors. The formation component count rate will also be reduced with the tag material present in the borehole region, since many of the thermal neutrons primarily decaying in the formation may actually be captured in the borehole region (this is the same reason a large number of iron gamma rays are seen in spectra from time intervals after the neutron bursts dominated by the formation decay component, although the only iron present is in the well tubular(s) and tool housing in the borehole region).

Since most modern PNC tools also measure the borehole component decay, an increase in the borehole capture cross-section $\Sigma_{bh}$ and a decrease in the borehole component count rate due to the high thermal neutron capture cross section material in the post-fracture log relative to the pre-fracture log could indicate the presence of proppant in the vicinity of the borehole, which is also usually indicative of the presence of induced fracturing in the adjacent formation. The detected capture gamma count rates can be summed in various time windows/gates between the neutron bursts, and the inelastic gamma count rates can be measured during a time gate during the neutron bursts.

Figure 4:
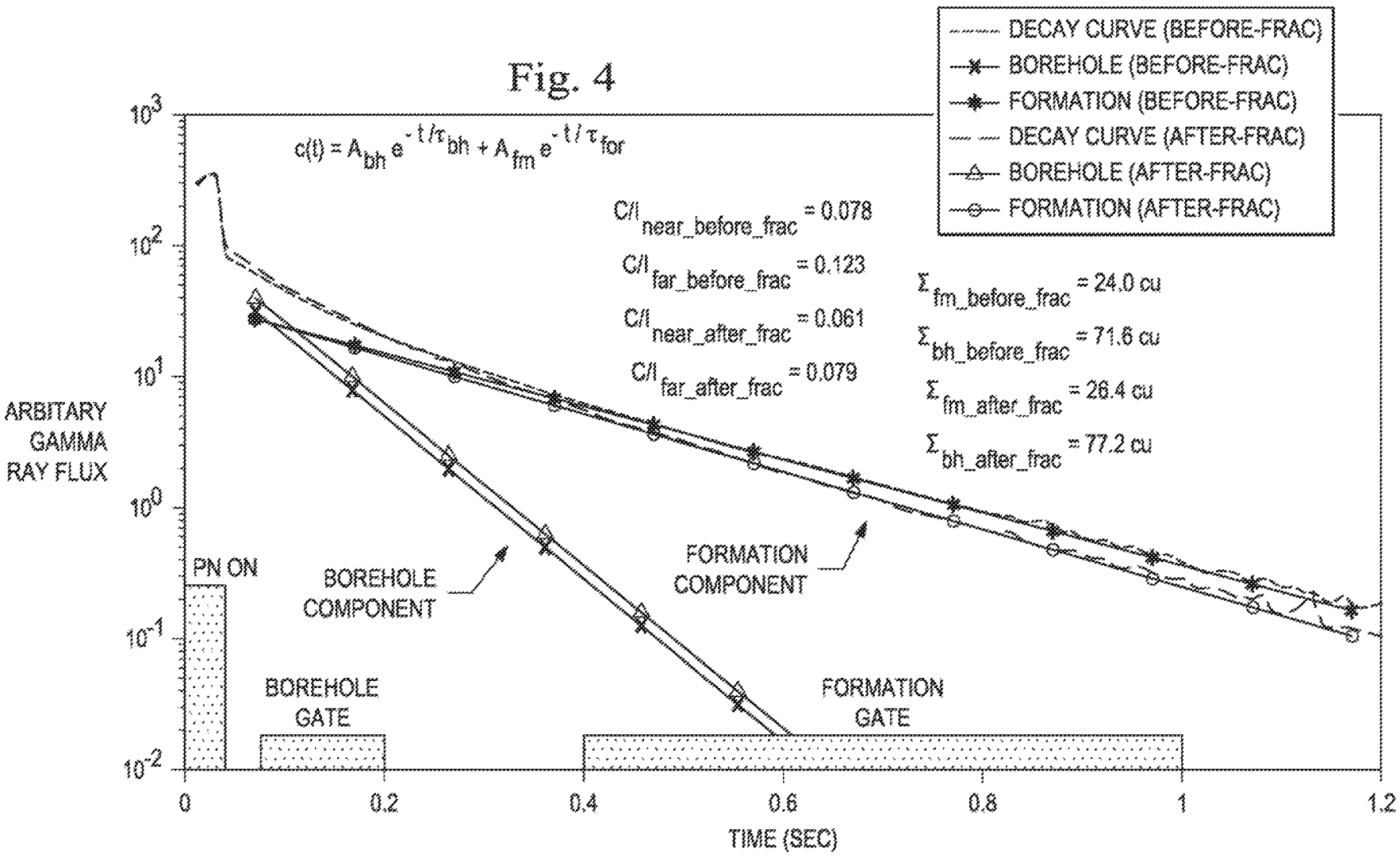
FIG. 4 shows modeled points along the decay curves of detected thermal neutron capture gamma rays using a 14 MeV Pulsed Neutron Generator for a detector at a given spacing from the source, the decay curve data before and after proppant doped with $Gd_2O_3$ is placed in fractures, together with the computed ratios of detected capture to inelastic gamma rays (C/I), and computed formation and borehole decay components in both equation and graphical representations. Also shown are positions in time during and after the neutron burst where time gates might be placed in order to detect/count inelastic gamma radiation (gate during burst) and capture gamma radiation (two different time gates after burst).

FIG. 4 shows MCNP5 modeled results for a method utilizing a PNC tool. NaI gamma ray detectors were used in all of the PNC models. The data was obtained using a hypothetical 1.6875 inch diameter PNC tool to collect the pre-fracture data and the post-fracture data in a 28.3% porosity formation, with proppant having 0.42% gadolinium oxide in a 1.0 cm wide fracture modeled in the post/after fracture data. Unless otherwise noted, borehole and formation conditions are the same as described in FIG. 3A. The total count rates in each time bin along each of the decay curves are represented as points along the time axis (x axis). The computed formation decay components from the two exponential fitting procedures from the pre-fracture and post-fracture data are the more slowly decaying exponentials (the upper lines in the figures) plotted on the total decay curve points in each figure. The more rapidly decaying curves from the fitting procedure represent the borehole decay components. The data in FIG. 4 are from the near detector; similar data were collected and processed from the far detector. The divergence of the decay curve in the earlier portions of the curve from the solid line is due to the additional count rate from the more rapidly decaying borehole component. The points representing the more rapidly decaying borehole region decay shown in the figures were computed by subtracting the computed formation component from the total count rate (other dual exponential curve decomposition methods well known to those of ordinary skill in the art could also be used to process the decay curve data). Superimposed on each of the points along the borehole decay curves are the lines representing the computed borehole exponential equations from the two exponential fitting algorithms. The good fits between the points along the decay curves and the computed formation and borehole exponential components confirm the validity of the two exponential approximations.

Modeled PNC data was also collected with the fractures in the perp orientation relative to the tool (see FIG. 3B). The formation component capture cross-sections, $\Sigma_{fm}$, are not observed to change as much as would be computed from purely volumetric considerations, there are nevertheless some increases observed in $\Sigma_{fm}$ with the doped proppant in the fracture, depending on detector spacing. The orientation of the tool in the borehole relative to the fracture (para vs. perp data) is not as significant as was observed for the compensated neutron tools.

As seen in FIG.4, the count rates can be accumulated in several time gates, with the time gate (0-30 μsec) during the neutron burst being used to collect inelastic gamma rays and possibly a small amount of residual capture gamma rays from the previous pulse cycle (if not subtracted out using methods well known to those of ordinary skill in the pulsed neutron logging art). The 80-200 μsec time gate is used to collect capture count rate data which contains a high percentage of counts from the near borehole region (including the borehole fluid, cement, and any proppant in the cement region), as well as counts from the formation. The 400-1000 μsec gate is used to collect counts primarily originating in the formation and the fracture in the formation. Also shown in FIG. 4 are the near detector $\Sigma_{fm}$ and $\Sigma_{bh}$ capture cross sections and C/I ratios (using the 400-1000 μsec time gate for the capture count rate) computed from the decay curves for both the pre-fracture versus post-fracture data sets. The pre-fracture vs. post-fracture C/I ratio values computed from the far detector decay data are also shown in Fig. 4 (although the far detector decay curves are not shown in FIG. 4). It can be clearly seen that all of these parameters, and especially $\Sigma_{fm}$ and C/I ratio, are very sensitive to the presence of the tag material in the proppant ($\Sigma_{fm}$ increases about 10% and C/I ratio decreases over 20% when the proppant tagged with 0.4% $Gd_2O_3$ is present). The decay curve data shown in FIG. 4 (and data from similar decay curves) were used to develop the inelastic and capture count rate data and C/I ratios presented and discussed in Tables 1-5 below.

Also, from Equation 1, the integral over all time of the exponentially decaying count rate from the formation component as can be computed as $A_{fm}*\tau_{fm}$, where $A_{fm}$ is the initial magnitude of the formation decay component and $\tau_{fm}$ is the formation component exponential decay constant. The computed formation component $A_{fm}*\tau_{fm}$ count rate integral decreases significantly with the doped proppant in the fracture. In some situations $A_{fm}*\tau T_{fm}$ could be used as a count rate indicator instead of the count rate observed during a time interval after the neutron bursts in which the formation component count rate dominates (for example 400-1000 μsec). Similarly, $A_{bh}*\tau_{bh}$ could be employed instead of the capture count rate in an earlier (e.g. 80-200 μsec) time gate.

MCNP5 PNC tool modeling data in Tables 1-5 below present both inelastic gamma ray count rates (during the 30 μs neutron burst) and capture gamma ray count rates (during four different time gates following the neutron burst), and also the C/I ratio. The formation modeled was a 28% porosity water sand containing a 5.5" casing in an 8" borehole, with neat cement in the casing-borehole annulus; the bi-wing fracture width was 1.0 cm, and contained several different $Gd_2O_3$ NRT tag concentrations (0.1%, 0.2%, and 0.4%) in the proppant used in the frac slurry. The pre-frac (baseline) count rate and C/I ratio data are compared with corresponding post-fracture data, and the differences are shown in the Tables.

The percentage change in inelastic count rate is shown in Table 1, and clearly indicates that even for a wide fracture and high (0.4%) NRT tag material concentration, there is very little change (≤~1%) in the inelastic gamma ray count rate in either detector. The corresponding percentage change in capture gamma ray count rate for the same formation/fracture conditions are given in Table 2 and Table 3 for four different time gates after the neutron bursts. The earliest "borehole" gate from 80-200 μs contains the highest percentage of borehole counts, which actually are seen to slightly increase with tagged proppant present. The intermediate gate from 200-400 μs contains both borehole and formation counts, and can include significant counts from the region where the fracture is in cement. The latest gate from 400-1000 μs after the burst is dominated by secondary gamma rays from the thermal neutrons decaying in the formation region, where the formation fracture is located. It is clear that the C/I ratio calculated from the late time gate has better sensitivity to the tagged proppant in a propped fracture out in the formation. The gate from 200-1000 μs contains a relatively higher percentage of borehole counts compared to the gate from 400-1000 μs.

It is clear from this data that if focus is directed to later time gates, very significant (and similar) suppressions in capture gamma count rates are observed in each detector, even at lower tag material concentrations. The C/I ratio data, computed from the modeled count rates in Tables 1, 2 and 3, are shown in Table 4 and 5. Since the inelastic count rates are not affected significantly by the tagged proppant, the percentage changes in the C/I ratio data in Tables 4 and 5 closely compare with the capture count rate changes in Tables 2 and 3. It is clear from this data, as from the field log data described below, that C/I ratio, especially when using a later time gate for detecting capture gamma rays, is a very useful indicator of the presence of NRT tagged proppant.

Table 1 shows the inelastic gamma ray count rate change (%) vs. $Gd_2O_3$ tag concentration in a 1.0 cm fracture (in a 30 μs time window/gate, during the neutron burst).

TABLE 1

| | Inelastic gamma ray time window 0-30 μs | |
|---|---|---|
| $Gd_2O_3$ Concentration in proppant (% by wt.) in 1.0 cm fracture | Δ Near detector (%) | Δ Far detector (%) |
| 0.00% (no fracture) | 0.00% | 0.00% |
| 0.10% | 0.48% | 0.04% |
| 0.20% | 0.98% | 0.65% |
| 0.40% | 1.62% | 1.47% |

Table 2 shows the capture gamma ray count rate change (%) vs. $Gd_2O_3$ tag concentration in a 1.0 cm fracture (in two different relatively early time windows/gates following the neutron burst).

TABLE 2

| | Capture gamma ray time window | | | |
|---|---|---|---|---|
| | 80-200 μs | | 200-400 μs | |
| $Gd_2O_3$ Concentration in proppant (% by wt.) in 1.0 cm fracture | Δ Near detector (%) | Δ Far detector (%) | Δ Near detector (%) | Δ Far Detector (%) |
| 0.00% (no-fracture) | 0.0% | 0.0% | 0.0% | 0.0% |
| 0.10% | 4.1% | 5.7% | −3.1% | −1.6% |
| 0.20% | 4.1% | 6.0% | −5.7% | −3.3% |
| 0.40% | 3.3% | 5.6% | −7.4% | −5.1% |

Table 3 shows the capture gamma ray count rate change (%) vs. $Gd_2O_3$ tag concentration in a 1.0 cm fracture (in two different relatively later time windows/gates following the neutron burst).

TABLE 3

| | Capture gamma ray time window | | | |
|---|---|---|---|---|
| | 200-1000 μs | | 400-1000 μs | |
| $Gd_2O_3$ Concentration in proppant (% by wt.) in 1.0 cm fracture | Δ Near detector (%) | Δ Far detector (%) | Δ Near detector (%) | Δ Far Detector (%) |
| 0.00% (no-fracture) | 0.0% | 0.0% | 0.0% | 0.0% |
| 0.10% | −6.5% | −5.6% | −14.6% | −13.1% |
| 0.20% | −9.6% | −8.0% | −18.6% | −16.8% |
| 0.40% | −11.5% | −10.1% | −21.0% | −19.7% |

Table 4 shows the Capture-to-Inelastic ratio (C/I) change (%) vs. $Gd_2O_3$ tag concentration in a 1.0 cm fracture (in two different relatively early time windows/gates following the neutron burst).

TABLE 4

| | Capture gamma ray time window | | | |
|---|---|---|---|---|
| | 80-200 μs | | 200-400 μs | |
| $Gd_2O_3$ Concentration in proppant (% by wt.) in 1.0 cm fracture | Δ Near detector (%) | Δ Far detector (%) | Δ Near detector (%) | Δ Far Detector (%) |
| 0.00% (no-fracture) | 0.0% | 0.0% | 0.0% | 0.0% |
| 0.10% | 3.6% | 5.7% | −3.5% | −1.7% |
| 0.20% | 3.1% | 5.3% | −6.6% | −3.9% |
| 0.40% | 1.6% | 4.1% | −8.9% | −6.4% |

Table 5 shows the Capture-to-Inelastic ratio (C/I) change (%) vs. $Gd_2O_3$ tag concentration in a 1.0 cm fracture (in two different relatively later time windows/gates following the neutron burst).

TABLE 5

| | Capture gamma ray time window | | | |
|---|---|---|---|---|
| | 200-1000 μs | | 400-1000 μs | |
| $Gd_2O_3$ Concentration in proppant (% by wt.) in 1.0 cm fracture | Δ Near detector (%) | Δ Far detector (%) | Δ Near detector (%) | Δ Far Detector (%) |
| 0.00% (no-fracture) | 0 | 0.0% | 0 | 0 |
| 0.10% | −7.0% | −5.6% | −15.0% | −13.1% |
| 0.20% | −10.4% | −8.6% | −19.4% | −17.3% |
| 0.40% | −12.9% | −11.4% | −22.2% | −20.9% |

PNC formation parameters, as described earlier, are less sensitive than neutron or compensated neutron to changes in non-proppant related changes in borehole conditions between the pre-fracture and post-fracture logs (such as borehole fluid salinity changes or changes in casing conditions). This is due to the ability of PNC systems to separate formation and borehole components.

An exemplary field well log comparison of pre-fracture and post-fracture logs using a PNC tool with a capture gamma ray detector or a thermal neutron detector is shown in FIGS. 5A and 5B. The example illustrates the experimental utilization of the C/I ratio (designated as RCI in FIG. 5A), shown together with the Sigma-Fm, Sigma-BH, capture gamma count rate, and Gd yield overlays between pre-fracture and post-fracture NRT pulsed neutron logs.

In the log, the following pre-fracture curves are overlain with the corresponding post-fracture curves. From left to right on the log: track 1—natural gamma ray; track 2—perforations; track 3—near/far capture gamma ray count rate ratio RNF (indicates changes in formation hydrogen index between the logs); track 4—RCI from near detector; track 5—RCI from far detector; track 6—Sigma-BH; track 7—Sigma-Fm, track 8—Near detector capture gamma count rate; track 9—Far detector capture gamma ray count rate; track 10—Gd yield computed from near detector capture gamma ray spectra. Track 11 shows the evaluated tagged proppant flag, using input from all the NRT logs. Hatched shading in tracks 4-10 indicates the presence of tagged proppant (indicated by lower RCI ratios, lower capture gamma count rates, higher Sigma-BH, higher Sigma-Fm, and higher Gd yield on the post-fracture log). It is clear from this experimental RCI log display that the RCI ratio suppression on the post-fracture logs in tracks 4 and 5 gives similar indications of the presence of NRT tagged proppant from depth intervals of about ×280 to ×327 as are obtained from the Sigma-BH, Sigma-Fm, Near detector capture gamma count rate, Far detector capture gamma ray count rate, and Gd yield curves in tracks 6-10. Indications of relative depth of investigation of the various curves can also be seen in FIGS. 5A and 5B. Significant tagged proppant is present in the borehole region, as well as in the formation, from depths of about ×305 to ×327, and the presence of the tagged proppant is sensed differently by the different logs: Sigma-BH is the shallowest measurement, primarily sensing the borehole region, and shows the biggest relative tag material effect in this zone; the capture count rates, the Gd yield, and RCI logs are all sensitive to proppant in both the borehole and formation, and that can be seen in the log data; and Sigma-Fm mostly senses tagged proppant out in the fracture in the formation, and can be seen to be relatively less affected by the proppant in the borehole region. Unlike the capture gamma ray count rate comparison, the C/I ratio (RCI in FIG. 5A) comparison is independent of neutron generator output (except for the repeatability of the logs related to the statistical uncertainties associated with differences in neutron source strength).

Although interpretation of the presence of tagged proppant in induced fractures (or changes in tagged proppant between two post-fracture NRT logs) is generally possible by utilizing the PNC methods described, it still may be advantageous to augment the pre-fracture and post-fracture proppant identification logs with: (1) conventional production logs, (2) gamma ray logs to locate radioactive salt deposition in zones resulting from production, (3) acoustic logs to detect open fractures, (4) other log data, and/or (5) field information. In situations where it is desired to determine changes in the presence of tagged proppant between two post-fracture logs (due to production of well fluids between the two logs), this method is particularly useful relative to prior technology utilizing radioactive tracers. This type of post-fracture information could not be obtained using fracture identification methods in which relatively short half-life radioactive tracers are pumped downhole, since radioactive decay would make the subsequent post-fracture logs useless. This would not be a problem with the methods described herein, since the characteristics/properties of gadolinium (or other good thermal neutron absorber) tagged proppants do not change over time.

Although the principal application of the C/I ratio to detect tagged proppant has been applied to conventional formation fracture evaluation applications, the same principles apply to the corresponding use of the C/I ratio in the non-radioactive tracer (NRT) based evaluation of downhole gravel pack, frac pack, and wellbore cement placement. In these other applications, the NRT tag material can be incorporated into and/or combined with the pack/cement solids placed in the gravel pack, frac pack or cement, and the evaluation to locate the placed pack material or cement can be made by comparing C/I ratios from a pre-pack/pre-cement PNC logging operation with a corresponding post-placement log. These utilizations of NRT tagged proppant (or using other tagged packing/cementing solids) are discussed in detail in U.S. Patent Application Publication No. 2013/0292109, which is incorporated by reference herein in its entirety.

Exemplary embodiments of the present disclosure further relate to any one or more of the following paragraphs:

1. A method for determining the location and height of frac-pack particles placed in a borehole region and in a fracture in a subterranean formation as a result of a frac-pack procedure, comprising: (a) obtaining a pre-frac-pack data set resulting from: (i) lowering into a borehole traversing a subterranean formation a pulsed neutron logging tool comprising a neutron source and a detector, (ii) emitting neutron pulses from the neutron source into the borehole and the subterranean formation, and (iii) detecting in the borehole inelastic and capture gamma rays resulting from nuclear reactions in the borehole and the subterranean formation; (b) obtaining a first capture to inelastic gamma ray count ratio (first C/I ratio) from the pre frac-pack data set; (c) utilizing a frac-pack slurry comprising a liquid and frac-pack particles to hydraulically fracture the subterranean formation to generate a fracture and to place the particles into the fracture and also into a frac-pack zone portion of the borehole in the vicinity of the fracture, wherein at least a portion of such frac-pack particles includes a thermal neutron absorbing material; (d) obtaining a post-frac-pack data set by: (i) lowering into the borehole traversing the subterranean formation a pulsed neutron logging tool comprising a pulsed neutron source and a detector, (ii) emitting pulses of neutrons from the last-mentioned neutron source into the borehole and the subterranean formation, (iii) detecting in the borehole inelastic and capture gamma rays resulting from nuclear reactions in the borehole and the subterranean formation; (e) obtaining a second capture to inelastic gamma ray count ratio (second C/I ratio) from the post-frac-pack data set; (f) comparing the first C/I ratio and the second C/I ratio to determine the location of the frac-pack particles; and (g) correlating the location of the frac-pack particles to a depth measurement of the borehole to determine the location and height of the fracture in the formation, and also at least one member selected from the group consisting of the location, axial distribution, radial distribution, and height of frac-pack particles placed in the borehole region in the vicinity of the fracture.

2. The method according to paragraph 1, wherein the thermal neutron absorbing material is selected from the group consisting of gadolinium oxide, boron carbide, and samarium oxide and any combinations thereof.

3. The method according to paragraphs 1 or 2, wherein the thermal neutron absorbing material comprises from about 0.025 wt % to about 4 wt % based on the total weight of the frac-pack particles including the thermal neutron absorbing material.

4. A method for determining the location and height of gravel-pack particles placed in a gravel-pack zone within a subterranean borehole region as a result of a gravel-pack procedure, comprising: (a) obtaining a pre-gravel-pack data set resulting from: (i) lowering into a borehole traversing a subterranean formation a pulsed neutron logging tool comprising a neutron source and a detector, (ii) emitting neutron pulses from the neutron source into the borehole and the subterranean formation, and (iii) detecting in the borehole inelastic and capture gamma rays resulting from nuclear reactions in the borehole and the subterranean formation; (b) obtaining a first capture to inelastic gamma ray count ratio (first C/I ratio) from the pre-gravel-pack data set; (c) utilizing a gravel-pack slurry comprising a liquid and gravel-pack particles to hydraulically place the particles into a region of the borehole, wherein all or a fraction of such gravel-pack particles includes a thermal neutron absorbing material; (d) obtaining a post-gravel-pack data set by: (i) lowering into the borehole traversing the subterranean formation a pulsed neutron logging tool comprising a pulsed neutron source and a detector, (ii) emitting pulses of neutrons from the last-mentioned neutron source into the borehole and the subterranean formation, (iii) detecting in the borehole inelastic and capture gamma rays resulting from nuclear reactions in the borehole and the subterranean formation; (e) obtaining a second capture to inelastic gamma ray count ratio (second C/I ratio) from the post-gravel-pack data set; (f) comparing the first C/I ratio and the second C/I ratio to determine the location of the gravel-pack particles; and (g) correlating the location of the gravel-pack particles to a depth measurement of the borehole to determine the location, height, and/or percent fill of gravel-pack particles placed in the gravel-pack zone within the borehole region.

5. The method according to paragraph 4, wherein the thermal neutron absorbing material is selected from the group consisting of gadolinium oxide, boron carbide, and samarium oxide and any combinations thereof.

6. The method according to paragraphs 4 or 5, wherein the thermal neutron absorbing material comprises from about 0.025 wt % to about 4 wt % based on the total weight of the gravel-pack particles including the thermal neutron absorbing material.

7. A method for distinguishing proppant placed in a subterranean formation fracture from proppant placed in a borehole region in the vicinity of the formation fracture as a result of a conventional frac procedure comprising: (a) obtaining a pre-fracture data set resulting from: (i) lowering into a borehole traversing a subterranean formation a pulsed neutron logging tool comprising a neutron source and a detector, (ii) emitting neutron pulses from the neutron source into the borehole and the subterranean formation, and (iii) detecting in the borehole inelastic and capture gamma rays resulting from nuclear reactions in the borehole and the subterranean formation; (b) obtaining a first capture to inelastic gamma ray count ratio (first C/I ratio) from the pre fracture data set; (c) hydraulically fracturing the subterranean formation to generate a fracture with a slurry comprising a liquid and a proppant in which at least a portion of such proppant includes a thermal neutron absorbing material; (d) obtaining a post-fracture data set by: (i) lowering into the borehole traversing the subterranean formation a pulsed neutron logging tool comprising a pulsed neutron source and a detector, (ii) emitting pulses of neutrons from the last-mentioned neutron source into the borehole and the subterranean formation, (iii) detecting in the borehole inelastic and capture gamma rays resulting from nuclear reactions in the borehole and the subterranean formation; (e) obtaining a second capture to inelastic gamma ray count ratio (second C/I ratio) from the post-fracture data set; and (f) comparing the first C/I ratio and the second C/I ratio to determine the effectiveness of proppant placement in the subterranean formation fracture relative to proppant placed in the borehole region adjacent to the formation fracture.

8. The method according to paragraph 7, wherein the thermal neutron absorbing material is selected from the group consisting of gadolinium oxide, boron carbide, and samarium oxide and any combinations thereof.

9. The method according to paragraphs 7 or 8, wherein the thermal neutron absorbing material comprises from about 0.025 wt % to about 4 wt % based on the total weight of the proppant including the thermal neutron absorbing material.

10. A method for determining the location of a cement slurry containing a thermal neutron absorbing material having a high thermal neutron capture cross-section placed in a borehole region as a result of a downhole cementing procedure, comprising: (a) obtaining a pre-cementing data set resulting from: (i) lowering into a borehole traversing a subterranean formation a pulsed neutron logging tool comprising a neutron source and a detector, (ii) emitting neutron pulses from the neutron source into the borehole and the subterranean formation, and (iii) detecting in the borehole inelastic and capture gamma rays resulting from nuclear reactions in the borehole and the subterranean formation; (b) obtaining a first capture to inelastic gamma ray count ratio (first C/I ratio) from the pre cementing data set; (c) utilizing a cement slurry comprising a liquid and solid particles to cement one or more well tubulars in place in the borehole penetrating the subterranean formation, wherein at least a portion of such solid particles includes the thermal neutron absorbing material; (d) obtaining a post-cementing data set by: (i) lowering into the borehole traversing the subterranean formation a pulsed neutron logging tool comprising a pulsed neutron source and a detector, (ii) emitting pulses of neutrons from the last-mentioned neutron source into the borehole and the subterranean formation, (iii) detecting in the borehole inelastic and capture gamma rays resulting from nuclear reactions in the borehole and the subterranean formation; (e) obtaining a second capture to inelastic gamma ray count ratio (second C/I ratio) from the post-cementing data set; (f) comparing the first C/I ratio and the second C/I ratio to determine the location of the particles containing the thermal neutron absorbing material; and (g) correlating the location of the particles containing the thermal neutron absorbing material to a depth measurement of the borehole to determine at least one member selected from the group consisting of the location, axial distribution, radial distribution, and height of the cement slurry placed in the borehole region.

11. The method according to paragraph 10, wherein the thermal neutron absorbing material is selected from the group consisting of gadolinium oxide, boron carbide, and samarium oxide and any combinations thereof.

12. The method according to paragraphs 10 or 11, wherein the thermal neutron absorbing material comprises from about 0.025 wt % to about 4 wt % based on the total weight of the solid particles including the thermal neutron absorbing material.

13. A method for distinguishing proppant placed in a subterranean formation fracture from proppant placed in a borehole region in the vicinity of the formation fracture as a result of a conventional frac procedure comprising: (a) obtaining a pre-fracture data set resulting from: (i) lowering into a borehole traversing a subterranean formation a pulsed neutron logging tool comprising a neutron source and a detector, (ii) emitting neutron pulses from the neutron source into the borehole and the subterranean formation, and (iii) detecting in the borehole fast neutrons (FN) and thermal neutrons (TN) resulting from nuclear reactions in the borehole and the subterranean formation; (b) obtaining a first fast neutron to thermal neutron count ratio (first FN/TN) from the pre fracture data set; (c) hydraulically fracturing the subterranean formation to generate a fracture with a slurry comprising a liquid and a proppant in which at least a portion of such proppant includes a thermal neutron absorbing material; (d) obtaining a post-fracture data set by: (i) lowering into the borehole traversing the subterranean formation a pulsed neutron logging tool comprising a pulsed neutron source and a detector, (ii) emitting pulses of neutrons from the last-mentioned neutron source into the borehole and the subterranean formation, (iii) detecting in the borehole FN and TN resulting from nuclear reactions in the borehole and the subterranean formation; (e) obtaining a second fast neutron to thermal neutron count ratio (second FN/TN) from the pre-fracture data set; and (f) comparing the first FN/TN and the second FN/TN to determine the effectiveness of proppant placement in the subterranean formation fracture relative to proppant placed in the borehole region adjacent to the formation fracture.

14. The method according to paragraph 13, wherein the thermal neutron absorbing material is selected from the group consisting of gadolinium oxide, boron carbide, and samarium oxide and any combinations thereof.

15. The method according to paragraphs 13 or 14, wherein the thermal neutron absorbing material comprises from about 0.025 wt % to about 4 wt % based on the total weight of the proppant including the thermal neutron absorbing material.

16. A method in a frac-pack procedure or a conventional frac procedure for indicating the amount of proppant placed in a subterranean formation fracture, independent of proppant placed in the borehole region, comprising: (a) obtaining a pre-fracture data set resulting from: (i) lowering into a borehole traversing a subterranean formation a pulsed neutron logging tool comprising a neutron source and a detector, (ii) emitting neutron pulses from the neutron source into the borehole and the subterranean formation, and (iii) detecting in the borehole inelastic and capture gamma rays resulting from nuclear reactions in the borehole and the subterranean formation; (b) obtaining a first capture to inelastic gamma ray count ratio (first C/I ratio) from the pre-fracture data set; (c) hydraulically fracturing the subterranean formation to generate a fracture with a slurry comprising a liquid and a proppant in which at least a portion of such proppant includes a thermal neutron absorbing material; (d) obtaining a post-fracture data set by: (i) lowering into the borehole traversing the subterranean formation a pulsed neutron logging tool comprising a pulsed neutron source and a detector, (ii) emitting pulses of neutrons from the last-mentioned neutron source into the borehole and the subterranean formation, (iii) detecting in the borehole inelastic and capture gamma rays resulting from nuclear reactions in the borehole and the subterranean formation; (e) obtaining a second capture to inelastic gamma ray count ratio (second C/I ratio) from the post-fracture data set; and (f) comparing the first C/I ratio and the second C/I ratio to determine the effectiveness of proppant placement in the subterranean formation fracture; and (g) computing the difference between the first C/I ratio and the second C/I ratio, wherein the difference is directly related to the amount of proppant placed in the fracture, independent of any additional proppant placed in the borehole region.

17. The method according to paragraph 16, wherein the thermal neutron absorbing material is selected from the group consisting of gadolinium oxide, boron carbide, and samarium oxide and any combinations thereof.

18. The method according to paragraphs 16 or 17, wherein the thermal neutron absorbing material comprises from about 0.025 wt % to about 4 wt % based on the total weight of the proppant including the thermal neutron absorbing material.

The foregoing description and embodiments are intended to illustrate the invention without limiting it thereby. Although the PNC tools described above use gamma ray detectors, it is possible that a similar C/I ratio concept could be employed by using fast neutron detector(s) to detect high energy neutrons during the neutron burst in place of the gamma ray detector(s) measuring inelastic gamma rays, and/or using thermal neutron detectors to detect thermal neutrons between the neutron bursts in place of gamma ray detectors for detecting capture gamma rays. It will be obvious to those of ordinary skill in the art that the invention described herein can be essentially duplicated by making minor changes in the material content or the method of manufacture. To the extent that such materials or methods are substantially equivalent, it is intended that they be encompassed by the following claims.

What is claimed is:

1. A method for detecting cement placed in a wellbore comprising:

obtaining a pre-cementing data set by:

emitting neutron pulses from a first neutron source into a borehole, and detecting in the borehole inelastic gamma rays and capture gamma rays;

obtaining a first capture gamma ray count rate and a first inelastic gamma ray count rate ratio from the pre-cementing data set;

obtaining a post-cementing data set by:

emitting pulses of neutrons from the first neutron source or a second neutron source into the borehole, and detecting in the borehole inelastic gamma rays and capture gamma rays;

obtaining a second capture gamma ray count rate and a second inelastic gamma ray count rate ratio from the post-cementing data set; and locating cement by combining the first capture gamma ray count rate, the first inelastic gamma ray count rate, the second capture gamma ray count rate, and the second inelastic gamma ray count rate; and correcting a location of the cement based on a change observed between the first and second inelastic gamma ray count rates by calculating a difference in the first capture gamma ray to inelastic gamma ray count ratio and the second capture gamma ray to inelastic gamma ray count ratio.

2. The method of claim 1, wherein the cement comprises thermal neutron absorbing material comprising gadolinium, boron, or samarium or any combinations thereof.

3. The method of claim 2, wherein the thermal neutron absorbing material comprises from about 0.025 wt % to about 4 wt % based on the total weight of the cement including the thermal neutron absorbing material.

4. The method of claim 1, further comprising:

obtaining a first capture gamma ray to inelastic gamma ray count ratio from the first capture gamma ray count rate and the first inelastic gamma ray count rate; and obtaining a second capture gamma ray to inelastic gamma ray count ratio from the second capture gamma ray count rate and the second inelastic gamma ray count rate, wherein detecting the cement comprises indicating a difference between the first capture gamma ray to inelastic gamma ray count ratio and the second capture gamma ray to inelastic gamma ray count ratio, and wherein calculating is independent of any changes in neutron output from the pulsed neutron source.

5. The method of claim 4, wherein the difference between the first capture gamma ray to inelastic gamma ray count ratio and the second capture gamma ray to inelastic gamma ray count ratio is directly related to an amount of cement placed in the borehole region.

6. The method of claim 1, wherein the capture gamma rays are detected in a time window between the neutron pulses.

7. The method of claim 6, wherein the time window begins at least about 200 microseconds after the end of each neutron pulse.

8. The method of claim 6, wherein the time window begins 400 microseconds or more after the end of each neutron pulse.

9. A method for detecting cement placed in a subterranean borehole region comprising:

obtaining a pre-procedure data set by:

emitting neutron pulses from a first neutron source into a borehole and a subterranean formation, and detecting in the borehole inelastic gamma rays and capture gamma rays;

obtaining a first capture gamma ray count rate and a first inelastic gamma ray count rate ratio from the pre-procedure data set;

mixing cement material with a thermal neutron absorbing material to provide a cement slurry.

placing the cement slurry in the subterranean borehole region to generate a cemented wellbore;

obtaining a post-procedure data set by:

emitting pulses of neutrons from the first neutron source or a second neutron source into the cemented borehole;

detecting in the cemented borehole inelastic gamma rays and capture gamma rays;

obtaining a second capture gamma ray count rate and a second inelastic gamma ray count rate ratio from the post-procedure data set; and detecting cement by combining the first capture gamma ray count rate, the first inelastic gamma ray count rate, the second capture gamma ray count rate, and the second inelastic gamma ray count rate;

wherein a change observed between the first and second inelastic gamma ray count rates is used to make a correction to the detection of the cement caused by changes in the neutron output of the first and/or second neutron sources by calculating a difference between the first capture gamma ray to inelastic gamma ray count ratio and the second capture gamma ray to inelastic gamma ray count ratio.

10. The method of claim 9, further comprising:

obtaining a first capture gamma ray to inelastic gamma ray count ratio from the first capture gamma ray count rate and the first inelastic gamma ray count rate; and obtaining a second capture gamma ray to inelastic gamma ray count ratio from the second capture gamma ray count rate and the second inelastic gamma ray count rate, wherein detecting the cement comprises indicating a difference between the first capture gamma ray to inelastic gamma ray count ratio and the second capture gamma ray to inelastic gamma ray count ratio, wherein the calculating is independent of any changes in neutron output from the pulsed neutron source.

11. The method of claim 9, wherein the capture gamma rays are detected in a time window between the neutron pulses.

12. The method of claim 11, wherein the time window begins after the end of each neutron pulse.

13. The method of claim 12, wherein the time window ends 400 microseconds or less after the end of each neutron pulse.

14. The method of claim 13, wherein the difference between the first capture gamma ray to inelastic gamma ray count ratio and the second capture gamma ray to inelastic gamma ray count ratio is directly related to an amount of cement placed in the borehole region.

* * * * *